US007328645B1

(12) United States Patent
Curry et al.

(10) Patent No.: US 7,328,645 B1
(45) Date of Patent: Feb. 12, 2008

(54) COMPENSATION SYSTEM FOR A FIREARM

(75) Inventors: Brett Curry, Chicopee, MA (US); Richard Mikuta, Easthampton, MA (US)

(73) Assignee: Smith & Wesson Corp., Springfield, MA (US)

( * ) Notice: Subject to any disclaimer, the term of this patent is extended or adjusted under 35 U.S.C. 154(b) by 314 days.

(21) Appl. No.: 10/773,500

(22) Filed: Feb. 6, 2004

Related U.S. Application Data

(60) Provisional application No. 60/446,629, filed on Feb. 11, 2003, provisional application No. 60/446,125, filed on Feb. 10, 2003.

(51) Int. Cl.
*F41A 21/00* (2006.01)

(52) U.S. Cl. ..... 89/14.3; 42/1.06

(58) Field of Classification Search ..... 89/14.3, 89/14.2, 14.4; 42/79, 1.06; D22/108
See application file for complete search history.

(56) References Cited

U.S. PATENT DOCUMENTS

D285,238 S * 8/1986 Cellini ..... D22/108
4,691,614 A * 9/1987 Leffel et al. ..... 89/14.3
4,930,396 A * 6/1990 Johnson ..... 89/14.3
5,076,137 A * 12/1991 Paredes ..... 89/14.3
5,305,677 A * 4/1994 Kleinguenther et al. ..... 89/14.2
5,305,678 A * 4/1994 Talbot et al. ..... 89/14.3
5,549,030 A * 8/1996 Lespron ..... 89/14.3
5,563,362 A * 10/1996 York ..... 89/14.3
6,482,248 B1 * 11/2002 Holloway ..... 75/249
D532,072 S * 11/2006 Price ..... D22/108
D536,054 S * 1/2007 Price ..... D22/108

OTHER PUBLICATIONS

Mag-na-port International Home Page (http://www.magnaport.com), dated Jan. 9, 2004, pp. 1-4.
Angle Porting—Machine Services (http://www.angleport.com/machine3.asp?C=90002), dated Jan. 9, 2004, p. 1.

* cited by examiner

*Primary Examiner*—Michael J. Carone
*Assistant Examiner*—Benjamin P Lee
(74) *Attorney, Agent, or Firm*—McCormick, Paulding & Huber LLP

(57) ABSTRACT

A compensation system for a firearm includes a barrel having a longitudinal bore that defines a firing axis. A compensator assembly is also included and has an attaching mechanism for releasably attaching the compensator assembly adjacent a muzzle end of the barrel. A gas discharge port is formed in the compensator assembly that is not aligned with the longitudinal bore. The gas discharge port communicates with an inner bore of the compensator assembly.

6 Claims, 10 Drawing Sheets

COMPENSATION SYSTEM FOR A FIREARM

CROSS REFERENCE TO RELATED APPLICATIONS

This application claims the benefit of U.S. Provisional Application Ser. No. 60/446,125, filed on Feb. 10, 2003, U.S. Provisional Application Ser. No. 60/446,629, filed on Feb. 11, 2003, and U.S. Pat. No. 6,266,908, issued on Jul. 31, 2001, all of which are hereby incorporated by reference in their entireties.

FIELD OF THE INVENTION

This invention relates in general to a compensation system for a firearm, and deals more particularly with compensation system for a firearm having a compensator assembly that is selectively removable from a firearm and which may be employed without damaging the barrel of a firearm.

BACKGROUND OF THE INVENTION

When a round of ammunition is fired from a firearm, handguns in particular, it is often the case that the barrel end of the firearm will 'jump', or kick upwards, as a result of the discharge of the round. As will be appreciated, this movement may affect the accuracy of a given shot while also making the accuracy of subsequent discharges problematic. Moreover, muscular fatigue from the jump (or 'kick') of the firearm, following the discharge of the firearm, is also generated.

As a consequence of firearm jump, manufacturers and hobbyists have adapted their firearms to employ a compensator, which lessens, to a certain degree, the magnitude of the jump experienced by a firearm after discharge of a round. Typically, these compensators take the form of a plurality of slots, which are milled in the barrel itself, adjacent the distal muzzle end of the firearm.

Generally, the milled, compensator slots act to vent a portion of the gases associated with the discharge of the round from the firearm. As the milled slots are typically arranged on the upper surface of the barrel, the force of the gases exiting the discharge slots tend to urge the firearm in a downward direction, thus compensating to some extend for the jump experienced by the firearm.

While successful to a certain degree, the milling of compensator discharge slots in the barrel of a firearm tend to deface the barrel itself, while also interfering somewhat with the effectiveness of the lands and grooves, if present, of any rifling that may be milled on the interior surface of the barrel. Moreover, known compensators oftentimes do not produce the most optimized performance characteristics due to the size and location of the discharge slots.

With the forgoing problems and concerns in mind, it is the general object of the present invention to provide a novel compensation assembly for a firearm.

SUMMARY OF THE INVENTION

It is an object of the present invention to provide a compensation system for a firearm.

It is another object of the present invention to provide a compensation system for a firearm that does not require the milling of discharge slots in the barrel of the firearm.

It is another object of the present invention to provide a compensation system for a firearm that may be selectively removable from a firearm.

It is another object of the present invention to provide a compensation system for a firearm that optimizes performance characteristics during the discharge of a round of ammunition.

It is another object of the present invention to provide a compensation system for a firearm that enables compensator assemblies of differing configurations to be utilized.

It is another object of the present invention to provide a compensation system for a firearm that permits for the quick and efficient interchange between compensator assemblies of differing configurations.

It is another object of the present invention to provide a compensation system for a firearm that effectively transfers the discharge force of a firearm.

It is another object of the present invention to provide a compensation system for a firearm that effectively transfers the discharge force of a firearm to the body of the firearm.

It is another object of the present invention to provide a compensation system for a firearm that counteracts the discharge force of a firearm.

It is another object of the present invention to provide a compensation system for a firearm that may assist in lower production and maintenance costs.

In a preferred embodiment of the present invention, a compensation system for a firearm includes a barrel having a longitudinal bore that defines a firing axis. A compensator assembly is also included and has an attaching mechanism for releasably attaching the compensator assembly adjacent a muzzle end of the barrel. A gas discharge port is formed in the compensator assembly that is not aligned with the longitudinal bore. The gas discharge port communicates with an inner bore of the compensator assembly.

These and other objectives of the present invention, and their preferred embodiments, shall become clear by consideration of the specification, claims and drawings taken as a whole.

DETAILED DESCRIPTION OF THE PREFERRED EMBODIMENT

Figure 1:
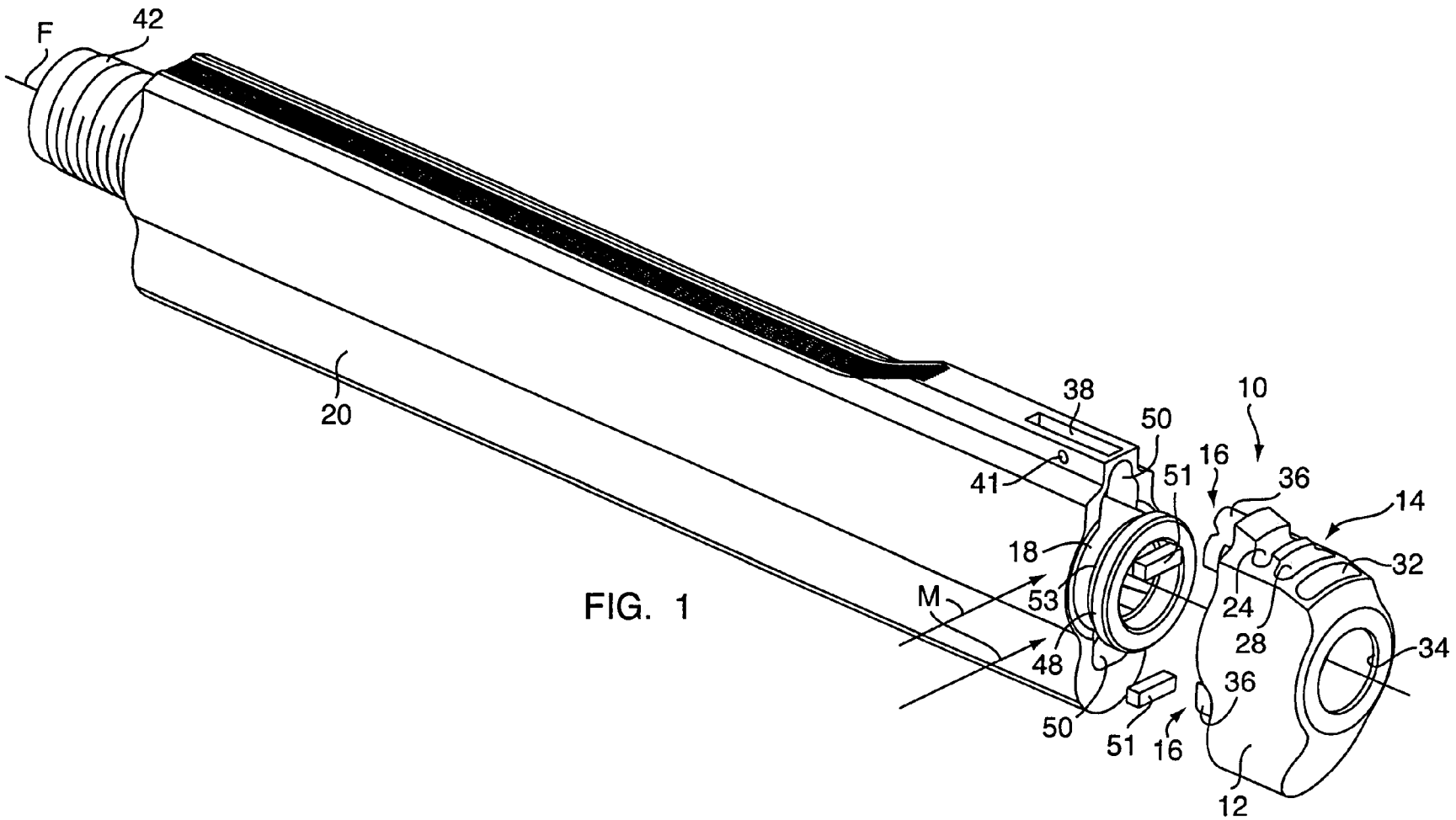
FIG. 1 is a partially exploded, isometric view of a compensation system for a firearm, in accordance with one embodiment of the present invention.

FIG. 1 is a partially exploded, isometric view of a compensation system for a firearm having a firearm compensator assembly 10, according to one embodiment of the present invention. As shown in FIG. 1, the compensator assembly 10 includes a housing 12, a plurality of arcuate gas discharge slots 14 and a mating assembly 16 that facilitates the mounting of the housing 12 onto a firearm barrel 18. In the embodiment illustrated in FIG. 1, the barrel 18 defines a firing axis F and is removably disposed with a firearm shroud 20, although alternative designs, such as but not limited to fixed barrel and shroud designs, are equally contemplated by the present invention.

The shroud 20 may be fabricated from a material having a density substantially less than the density of the material from which the barrel 18 is made, for reduced firearm weight. The upper surface of the barrel shroud 20 is substantially flat and has an axially elongated, upwardly open, sight receiving groove 38 formed therein which comprises a sight positioning portion of the shroud 20. The sight groove 38 is adapted to receive a forward sight 40 (shown in FIG. 8) which is pinned via pin hole 41, biased, or otherwise secured in fixed position to the shroud 20.

Still in reference to FIG. 1, although the gas discharge slots 14 have been described as being arcuate in form, the present invention is not limited in this regard as other, alternative shapes may be defined by the gas discharge slots 14 without departing from the broader aspects of the present invention. Indeed, the gas discharge slots 14 need not take the form of 'slots' per se, instead being formed as geometric openings of any predetermined size, shape and angular inclination in accordance with the preferred design characteristics of the firearm compensator assembly 10, as will be discussed in greater detail later.

Figure 2:
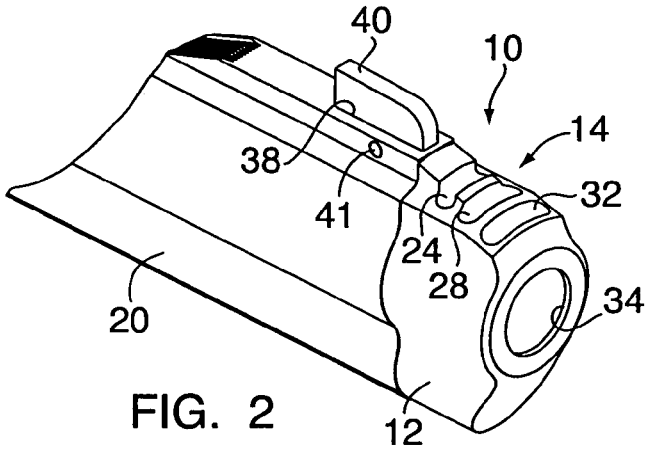
FIG. 2 is isometric view of the firearm compensator assembly mounted upon the distal end of a firearm barrel.

FIG. 2 illustrates the compensator assembly 10 after it has been mounted to the barrel 18 of the firearm. As shown in FIG. 2, and once mounted to the barrel 18, the housing 12 enjoys a tight fitting relationship with the barrel 18 and the integrated shroud 20, and instills thereby the advantages of the compensating gas discharge slots 14 without requiring any milling of these slots in the barrel 18, or the shroud 20, itself.

It is therefore an important aspect of the present invention that the compensator assembly 10 does not demand the expensive and labor-intensive milling of discharge slots in the barrel 18, or the shroud 20, of the firearm to which it is attached. Moreover, the selective mating of the compensator assembly 10 to the firearm gives a range of operational freedom not currently enjoyed by those firearms which have been adapted to include milled gas discharge slots in their barrels and/or shroud members. That is, once a firearm has been subjected to the known process of milling of the barrel or shroud, there is no effective method to return that firearm to its pre-milled condition, absent replacing the entire barrel or shroud. This stands in stark contrast to the flexibility provided by the present invention.

Figure 3:
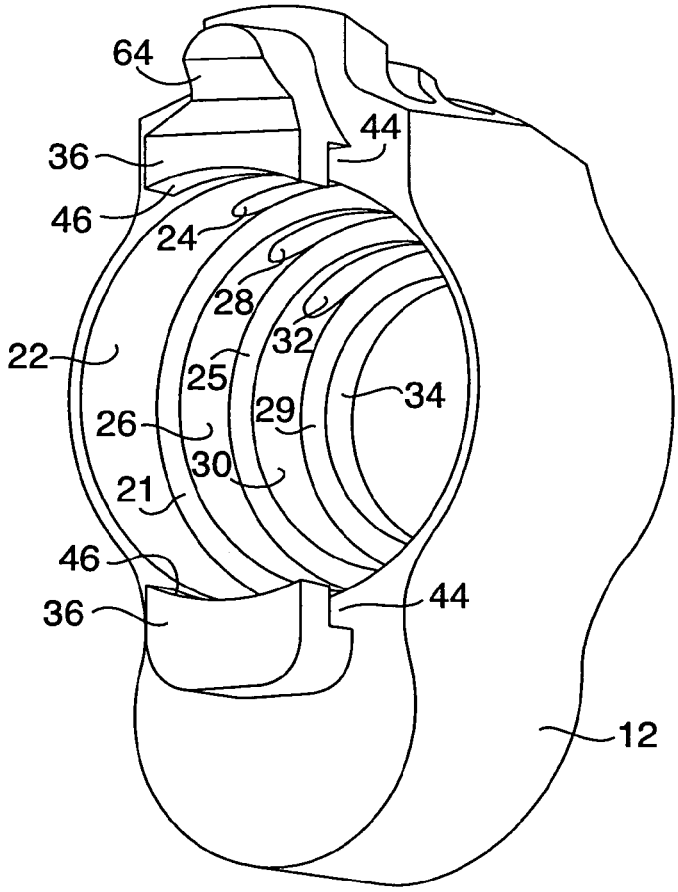
FIG. 3 is a rear, isometric view of the firearm compensator assembly shown in FIG. 1.

In addition to the compensator assembly 10 being selectively adaptable to the firearm upon which it is removably mounted, the structural configuration of the compensator assembly 10 has been designed to produce optimal performance characteristics, taking into account the issue of the reduction in muzzle velocity that is typical in firearms utilizing milled compensator assemblies. FIG. 3 is a rear, isometric view of the firearm compensator assembly 10 that illustrates one embodiment of the present invention's structural configuration.

As shown in FIG. 3, the housing 12 of the compensator assembly 10 does not define a uniform, interior diameter. Rather, the compensator assembly 10 includes a plurality of concentrically aligned bore diameters, defined by a matching plurality of concentrically aligned lands 21, 25 and 29, which serve to optimize the operational performance characteristics of the compensator assembly 10.

The diameter of a first bore 22 is the largest and is disposed to be adjacent the muzzle end of the barrel 18 when the compensator assembly 10 is mounted to the barrel 18. The land 21 of the first bore 22 enjoys a substantially co-planar relationship with the forward wall of a first gas discharge slot 24, formed in the upper surface of the housing 12.

In a preferred embodiment of the present invention, the first gas discharge slot 24 is substantially centered on the longitudinal firing axis of the barrel 18 and enjoys the smallest arc length of any of the discharge slots 14 formed in the compensator assembly 10.

Returning to FIG. 3, the diameter of a second bore 26 is smaller than that of the first bore 22. The land 25 of the first bore 22 also enjoys a substantially co-planar relationship with the forward wall of a second gas discharge slot 28, formed in the upper surface of the housing 12. The second gas discharge slot 28 is substantially centered on the longitudinal firing axis of the barrel 18 and defines a larger arc-length than does the first gas discharge slot 24.

Similarly, the diameter of a third bore 30 is smaller than that of both the first bore 22 and the second bore 26. Moreover, the land 29 of the third bore 30 enjoys a substantially co-planar relationship with the forward wall of a third gas discharge slot 32, formed in the upper surface of the housing 12. The third gas discharge slot 32 is also substantially centered on the longitudinal firing axis of the barrel 18 and enjoys a larger arc-length than both the first gas discharge slot 24 and the second gas discharge slot 28. A muzzle bore, or aperture, 34 is provided adjacent the front distal end of the compensator assembly 10. A pair of mounting arms 36 is also provided to the housing 12 as part of the mating assembly 16. The mounting arms 36 are utilized to mount the compensator assembly 10 to the barrel 18 of the firearm, as will be described in more detail later.

As illustrated in FIG. 3, the lands 21, 25 and 29 of the compensator assembly 10 are preferably formed so as to be vertically oriented and substantially perpendicular to the firing axis F. By forming the lands 21, 25 and 29 in this manner, and by having each of the lands 21, 25 and 29 sharing the forward wall of each of the gas discharge slots 24, 28 and 32, respectively, the present invention assuredly directs the discharged gases against the lands 21, 25 and 29, and up through the gas discharge slots 24, 28 and 32 upon each discharge of the firearm. That is, the surfaces of the lands 21, 25 and 29 provide impact surfaces to accept the force of the pressure wave of outwardly expanding gases upon each discharge of the firearm. In this manner, the outwardly expanding gasses will impact the surfaces of the lands 21, 25 and 29 and produce thereby a counter force, such that the net recoil of the firearm is reduced.

It is also another important aspect of the present invention that the substantially co-planar relationship between the matching lands and forward wall of the gas discharge slots effectively redirects the forward-rushing gases that are discharged during the firing of the firearm. It should also be noted, however, that although the lands 21, 25 and 29 of the compensator assembly 10 have been described as being vertically oriented and substantially perpendicular to the firing axis F, the present invention is not limited in this regard. That is, the present invention equally contemplates that the lands 21, 25 and 29 may be alternatively formed at an angle to the firing axis f, without departing from the broader aspects of the present invention. Such angled lands would be preferably matched to gas discharge slots having a similar angle to that of the lands themselves, thus maintaining the substantially co-planar relationship between the plane of the lands and the forward wall of the gas discharge slots. It will be readily appreciated, however, that gas discharge slots having an angle that differs from the angle of the lands is also contemplated by the present invention.

Moreover, although a compensator assembly 10 having three gas discharge slots 14 has been described in connection with FIGS. 1-3, the present invention also encompasses a compensator assembly having any number of gas discharge slots formed therein. It will also be readily appreciated that the arc-length of the discharge slots 14, and their dimensional relationship to one another, may also be varied from the relationship described in connection with FIG. 3, without departing from the broader aspects of the present invention.

Figure 4:
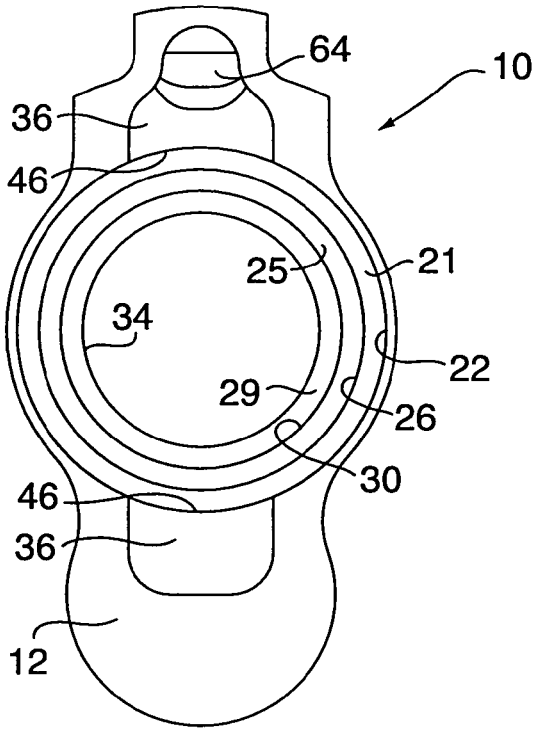
FIG. 4 illustrates a rear, partial cross-sectional view of the compensator assembly shown in FIG. 1.

Turning now to FIG. 4, a rear, partial cross-sectional view of the compensator assembly 10 is shown. As shown in FIG. 4, the first bore 22, the second bore 26, the third bore 30 and the muzzle bore 34 are each concentrically aligned with the firing axis F of the barrel 18. Indeed, as will be appreciated, the muzzle bore 34 is designed to be no smaller than the inner diameter of the barrel 18 and, more preferably, is designed to be substantially the same diameter of the barrel 18.

Figure 5:
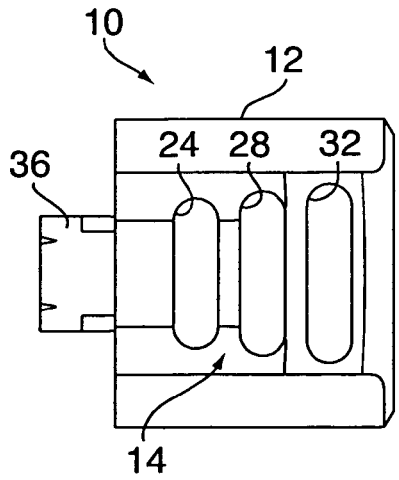
FIG. 5 is a top, plan view of the firearm compensator assembly shown in FIG. 1.
Figure 6:
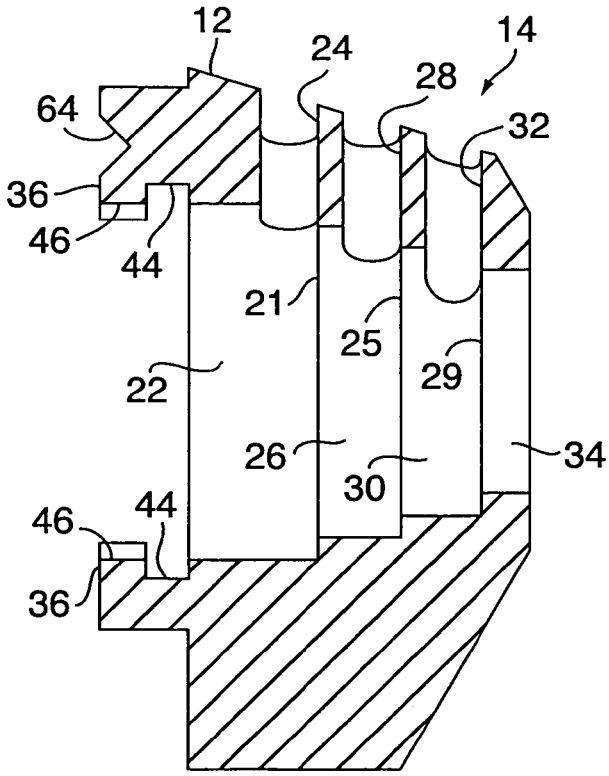
FIG. 6 is a partial cross-sectional side view of the firearm compensator assembly shown in FIG. 1.

Turning now to FIG. 5, a top, plan view of the firearm compensator assembly 10 is shown. As indicated previously, the arc-lengths of the first gas discharge slot 24, the second gas discharge slot 28 and the third gas discharge slot 32 are progressively larger, beginning from the back of the compensator assembly 10 to the front, distal end of the compensator 10. Indeed, FIG. 6 is a partial cross-sectional side view of the firearm compensator assembly 10 and also illustrates the preferred arcuate formation and differing arc-lengths of the gas discharge slots 24/28/32. FIG. 6 further illustrates how the lands 21, 25 and 29 enjoy a substantially co-planar relationship with the forward wall the gas discharge slots 24, 28 and 32, respectively.

It is therefore another important aspect of the present invention that the gas discharge slots 24/28/32 are progressively larger, with smaller arc-lengths beginning from the back of the compensator assembly 10 to larger arc-lengths adjacent the front, while the bore diameters 22/26/30 are themselves formed to be progressively smaller, with larger diameters beginning from the back of the compensator assembly 10 to smaller diameters adjacent the front. It has been determined that this particular structural configuration provides the preferred performance characteristic for the compensator assembly 10. That is, the structural configuration of the gas discharge slots 24/28/32 and the bore diameters 22/26/30 are designed to enhance the compensating effect on the jerk, or kick, of the firearm, while also maintaining the greatest possible muzzle velocity of the bullet discharged from the firearm.

As will be appreciated by consideration of FIGS. 1-6, the present invention provides a compensator assembly 10 that may be removably attached to the muzzle end of a firearm. Moreover, the compensator assembly 10 may be employed without the need for marring the integrity of the barrel or shroud of a firearm, or the lands and grooves of the rifling inscribed in the inner surface of the barrel. As previously noted, although a compensator assembly 10 having three gas discharge slots formed in three matching bore diameters has been described, more or less gas discharge slots and a differing number of bore diameters may be employed, without departing from the broader aspects of the present invention. Indeed, a compensator assembly having only a single inner diameter with one or more gas discharge slots is equally contemplated by the present invention.

A preferred method of mating the compensator assembly 10 to the barrel 18 and shroud 20 will now be explained in conjunction with FIGS. 3, 7 and 8. Although not shown in FIG. 7, it will be readily appreciated that the frame of the firearm to which the barrel 18 and shroud 20 are to be affixed will include matching, female threads to mate with the threaded end 42 of the barrel 18 in association with the final securing of the compensator assembly 10, as will be explained shortly.

Figure 7:
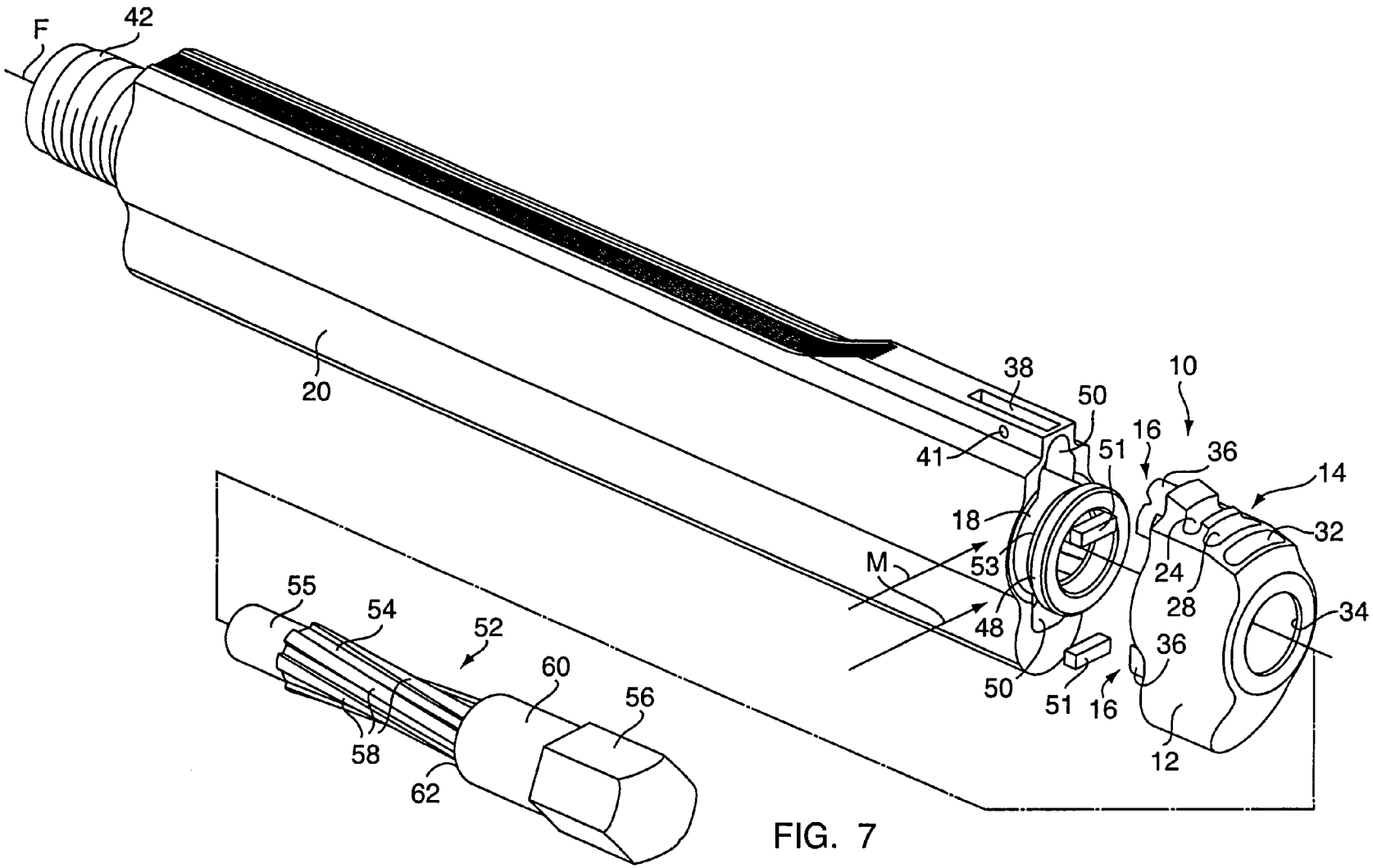
FIG. 7 is a partially exploded, isometric view of a compensator assembly, including a barrel and a shroud of a firearm, as they are being mated to one another via a mating tool.
Figure 8:
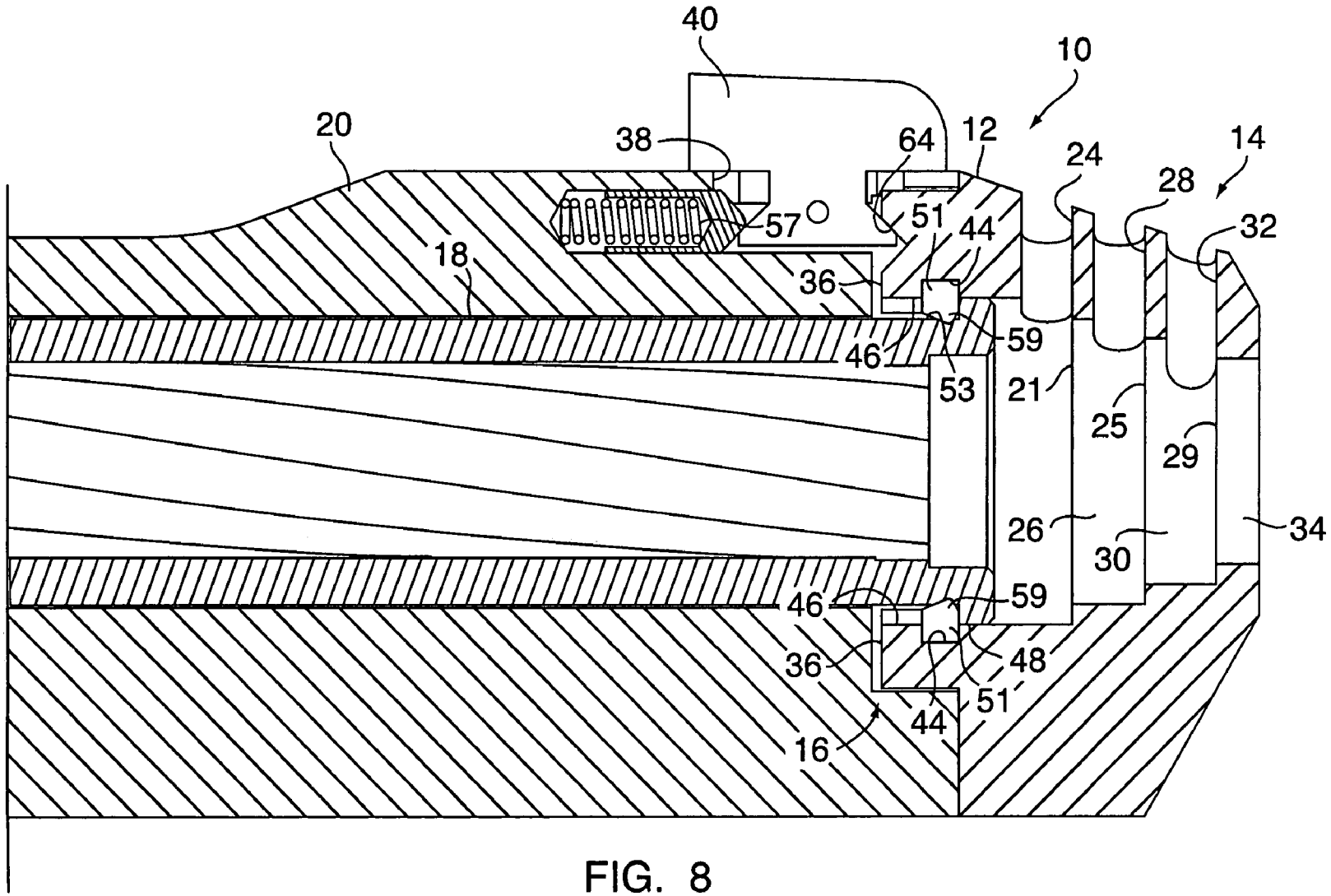
FIG. 8 is a cross-sectional view of the mated compensator assembly, barrel and shroud depicted in FIG. 7.

Considering now FIGS. 3, 7 and 8 in combination, it can be seen that the mounting arms 36 define opposing channels 44, which are sized in accordance with the distal end of the barrel 18. That is, each of the channels 44 are formed by an extended, arcuate lip 46 which substantially conforms to and accommodates a flange 48 that is formed at the distal end of the barrel 18.

The mating operation begins by an operator sliding the housing 12 of the compensator assembly 10 in a direction substantially perpendicular to the firing axis of the barrel 18. By sliding the housing 12 in the general direction of arrows M, the flange 48 with become loosely accommodated within the opposing channels 44. The housing 12 and the barrel 18 are urged towards one another in order to move the mounting arms 36 into receptacles 50 formed in the shroud 20. By doing so, a space is created in the opposing channels 44 such that a pair of spacers 51 may be slipped between the mounting arms 36 and the flange 48. The spacers 51 are preferably block, metal spacers which have the effect of pulling the compensator assembly 10 back against the front flange 48 of the barrel 18, as will be described in more detail later.

A special purpose barrel assembly tool, indicated generally at 52, is then employed to draw the partially assembled elements, noted above, in tight contact with one another. As shown in FIG. 7, the illustrated tool 52 has a generally cylindrical axially elongated shank 54 and an integral diametrically enlarged head 56 of non-circular cross-section at one end. The presently preferred head 56 has a hexagonal cross-section substantially as shown. At its opposite or leading end of the shank 54, a slightly conically tapered portion 55 converges in a direction away from the head 56 in a predetermined condition of alignment. The shank 54 is sized to be received within and substantially complement the muzzle bore 34 of the compensator assembly 10, including the barrel 18. The tool 52 further includes a plurality of spiral lands 58, which are equal in number to the rifling grooves, inscribed within the inner circumference of the barrel 18. The lands 58 project radially outwardly from the shank 54 and extend for some distance therealong, substantially as shown in FIG. 7.

The tool 52 is preferably made from a material somewhat softer than the material from which the barrel 18 is made, brass being the presently preferred material. A generally cylindrical sleeve 60 made from another material is received on the shank 54 adjacent the head 56, substantially as shown, and defines a generally radially disposed arresting surface 62 facing in the direction of the leading end of the tool shank. The sleeve 60 is preferably made from a material softer than the material from which the tool shank 54 is made. In accordance with the presently preferred construction, the sleeve 60 is formed from a non-metallic material, such as a plastic material.

Returning to FIG. 7, the leading end of the tool 52 is inserted into the muzzle end of the firearm, via the muzzle bore 34, and the lands 58 then engage the associated rifling grooves inscribed within the barrel 18. When the tool 52 is fully inserted into the barrel 18, the arresting surface 62 will engage with the front surface of the muzzle bore 34. A torque wrench or other suitable driving tool (not shown), such as but not limited to a pneumatic nut driver or the like, is then employed to apply a predetermined torque to the hexagonal head 56 on the tool 52. When the tool 52 is so rotated, the barrel 18 will seat itself into the body of the firearm, whereby the flange 48 will draw the mounting arms 36 further into the receptacles 50 and securely fix the spacers 51 therebetween. Upon completion of the mating operation, the tool 52 is removed from the muzzle bore 34.

FIG. 8 illustrates a cross-sectional view of the compensator assembly 10 as it is mated to the barrel 18 and shroud 20. As shown in FIG. 8, the forward sight 40 may be inserted into the sight groove 38 and become secured therein via an angled groove 64 formed in the upper mounting arm 36. The forward sight 40 is secured against disengagement by the compressive action of the flange 48 as it is drawn backwards by the rotation of the tool 52, as well as from the biasing force of a sight spring 57 housed within the shroud 20.

It will therefore be appreciated that another important aspect of the present invention lies in the compensator assembly 10 being mounted to the barrel 18 of the firearm integral with the mounting of the barrel 18 to the firearm itself. Moreover, it will be readily appreciated that a non-compensating assembly, such as would be exhibited if the housing 12 was devoid of any of the gas discharge slots 14, may be alternatively mounted to the firearm should an operator so choose.

It should also be noted that the pair of spacers 51 may be selectively deformed prior to the barrel 18 being rotated into threaded engagement with the frame of the firearm. As is most clearly seen in FIG. 8, the pair of block metal spacers 51 may be selectively deformed under an appropriate stressing force to thereby expand and fill the annular, inscribed groove 53. The deformed profile 55 of the spacers 51 as they substantially fill the opposing channels 44, defined by the mounting arms 36, and the inscribed groove 53, is also shown in FIG. 8.

It will be readily appreciated that when the spacers 51 are deformed to expand and fill the opposing channels 44 and the inscribed groove 53, the housing 12 of the compensator assembly 10 will be securely fixed to the barrel 18. Moreover, the deformation and subsequent expansion of the spacers 51 provide a tensioning force to the barrel 18, the shroud 20 and the compensator assembly 10, such that these elements are drawn together in a manner to withstand the forces exerted during a discharge of the firearm. Thus, the compensator assembly 10 will be pulled back against the front flange 48 of the barrel 18, effectively providing a mounting method and apparatus which ensures a tight fitting relationship between all integrated elements of the present invention.

Figure 9:
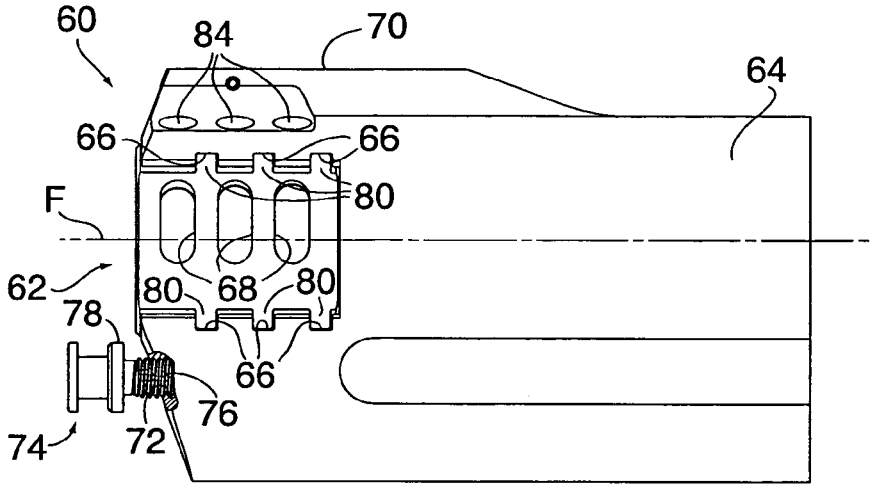
FIG. 9 is a side view of a compensation system for a firearm, in accordance with another embodiment of the present invention.
Figure 10:
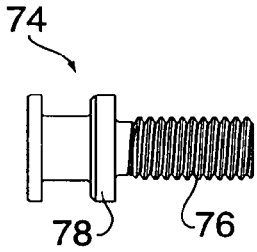
FIG. 10 is a side view of a locking bolt utilized in connection with the compensation system depicted in FIG. 9.
Figure 11:
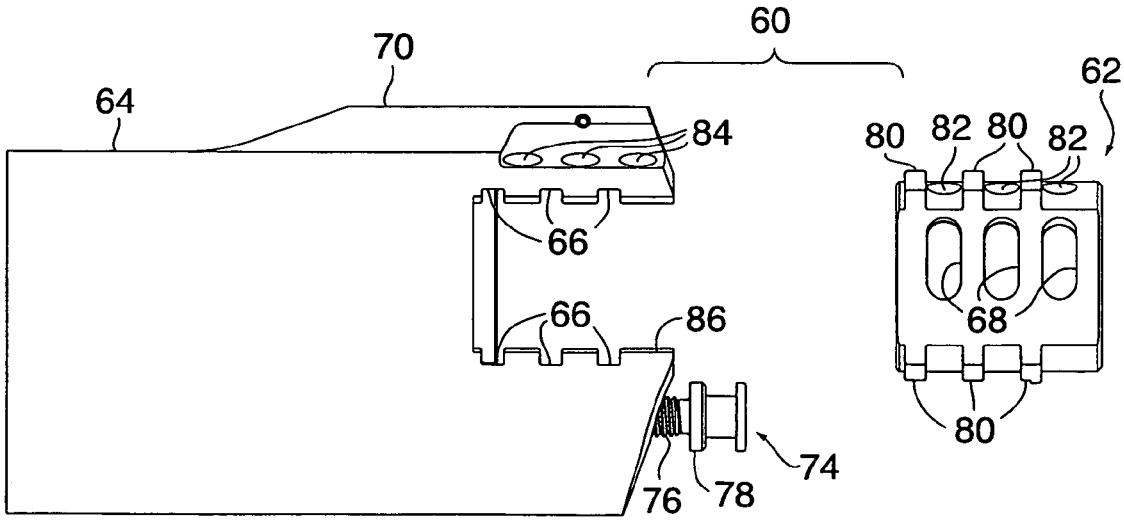
FIG. 11 is an opposite side view of the compensation system depicted in FIG. 9, in a disassembled configuration.

FIGS. 9-11 illustrate a compensation system 60 that includes a compensator assembly 62, in accordance with another embodiment of the present invention. Although performing similarly to the compensator assembly 10 discussed in conjunction with FIGS. 1-8, the compensation system 60 enjoys an expanded versatility, particularly with respect to the ease of assembly/disassembly, as well as providing for increased handling capability of the forces generated during discharge of the firearm.

As shown in FIG. 9, the compensation system 60 includes a shroud 64 having a series of three upper and lower relieved cuts 66 formed in the muzzle end thereof. The upper and lower relieved cuts 66 are preferably arcuate and form opposing engagement grooves for releasably accepting the compensator assembly 62. The compensator assembly 62 itself includes a plurality of gas discharge slots 68 formed in the side thereof.

The gas discharge slots 68 perform substantially the same function as the gas discharge slots 14 discussed in connection with FIGS. 1-8 and, moreover, the inner bore of the compensator assembly 62 is likewise formed to be substantially similar to the inner bore of the compensator assembly 10. That is, the inner bore of the compensator assembly 62 also includes a plurality of concentrically aligned bore diameters, defined by a matching plurality of concentrically aligned lands, each preferably having a differing bore diameter, which serve to optimize the operational performance characteristics of the compensator assembly 62.

Again similar to the compensator assembly 10, the lands disposed within the compensator assembly 62 enjoy a substantially co-planar relationship with the forward wall of the gas discharge slots 68. Moreover, the lands of the compensator assembly 62 are themselves preferably formed so as to be vertically oriented and substantially perpendicular to the firing axis F. By forming the lands in this manner, and by having each of the lands sharing the forward wall of each of the gas discharge slots 68 the compensator assembly 62 also assuredly directs the discharged gases against the lands and through the gas discharge slots 68 upon each discharge of the firearm. That is, the surfaces of the lands also provide impact surfaces to accept the force of the pressure wave of outwardly expanding gases upon each discharge of the firearm. In this manner, the outwardly expanding gasses will impact the surfaces of the lands of the compensator assembly 62 and produce thereby a counter force, such that the net recoil of the firearm is reduced.

It should also be noted, however, that although the lands of the compensator assembly 62 have been described as being vertically oriented and substantially perpendicular to the firing axis F, the present invention is not limited in this regard. That is, the present invention equally contemplates that the lands may be alternatively formed at an angle to the firing axis F, without departing from the broader aspects of the present invention. Such angled lands would be preferably matched to gas discharge slots having a similar angle to that of the lands themselves, thus maintaining the substantially co-planar relationship between the plane of the lands and the forward wall of the gas discharge slots. It will be readily appreciated, however, that gas discharge slots having an angle that differs from the angle of the lands is also contemplated by the present invention.

Moreover, although a compensator assembly 62 having three, side gas discharge slots 68 has been described in connection with FIG. 9, the present invention also encompasses a compensator assembly having any number of gas discharge slots formed therein. It will also be readily appreciated that additional gas discharge ports may be formed in the compensator assembly 62, in addition or as an alternative to the gas discharge slots 68. Indeed, gas discharge ports may be formed in the top, upper portion of the shroud 64, adjacent the location of a center raised portion 70, as desired or as required to meet performance characteristics, as will be discussed in more detail later.

Returning to FIG. 9, a threaded bore 72 is formed in the shroud 64, preferably substantially parallel to and below the firing axis F, and is adapted to receive a locking bolt 74. As best seen in FIG. 10, the locking bolt 74 includes a threaded portion 76 for integrally mating with the threaded bore 72, and is characterized by a raised flange 78 formed at approximately the midpoint thereof. The raise flange 78 of the locking bolt 74 work in conjunction with a plurality of matching, outwardly extending locking flanges 80 to secure the compensator assembly 62 to the shroud 64, as will be described hereinafter.

It will be readily appreciated that the locking flanges 80 are formed to match and integrally mate with the upper and lower relieved cuts 66 after the compensator assembly has been inserted into the shroud 64 and suitably rotated so that the flanges 80 are in registration with the relieved cuts 66, an orientation depicted in FIG. 9.

The primary purpose of the configuration of the flanges 80 and the relieved cuts is to allow for the recoil force of the outwardly expanding discharge gasses, accompanying each discharge of the firearm, to be absorbed by the shroud 62 and thereby producing a counter force, such that the net recoil of the firearm is reduced. As will be appreciated, the more efficient the coupling between the flanges 80 and the relieved cuts 66, the more efficient the compensator assembly 62 will be in reducing the recoil forces of the firearm.

Integral, therefore, to the efficiency of the compensator assembly 62 is the raised flange 78 of the locking bolt 74. As the locking bolt 74 is threaded into the threaded bore 72, the raised flange 78 will engage the forward-most, lower flange 80. That is, the raised flange 78 will selectively engage the lower flange that is most closely adjacent the muzzle end of the compensator assembly 62. This compressive force, which increases as the locking bolt 74 is further tightened in the threaded bore 72, allows the each of the flanges 80 to be preloaded within each of their respective relived cuts 66, thus preloading the entire compensator assembly 62 against the body of the shroud 64.

While effectively distributing a significant portion of the discharge forces against the body of the shroud 64, it will also be readily appreciated by those of skill in the art that the locking bolt 74 does not itself bear the brunt of the these discharge forces, therefore there is no significant disengagement force acting on the locking bolt 74. The present invention therefore not only effectively provides for a secure mating of the compensator assembly 62 to the shroud 64, and thus enabling the transfer of discharge forces to the body of the shroud 64, but also ensures that the compensator assembly 62 will remain engaged and correctly positioned even after repeated discharge of the firearm.

While a compensation system 60 has be described in which the compensator assembly 62 and the shroud 64 each define matching upper and lower sets of three flanges 80 and three relieved cuts 66, the present invention is not limited in this regard. That is, the present invention equally contemplates that one or more sets of matching flanges and relieved cuts may be formed in the compensator assembly 62 and the shroud 64, without departing from the broader aspects of the present invention.

Turning now to FIG. 11, the compensation system 60 is shown with the compensator assembly 62 being disengaged from the shroud 64. As can now be seen in FIG. 11, the compensator assembly 62 also includes a plurality of upper discharge apertures 82, formed in the top portion of the compensator assembly 62. As will be appreciated, when the compensator assembly 62 is properly oriented within the shroud 64, thus positioning the flanges 80 within their matching relieved cuts 66, the upper discharge apertures 82 will be in registration with similarly dimensioned gas discharge apertures 84 formed in the top, upper portion of the shroud 64, adjacent to and on either side of the center raised portion 70. As also shown by FIG. 11, the shroud 64 may also include a locking channel 86 formed adjacent the threaded bore 72 and extending longitudinally into in the lower, milled portion of the shroud 64.

As with all other embodiments discussed in connection with the present invention, it will be readily appreciated that although six upper discharge apertures 82 and six gas discharge apertures 84 have be illustrated in FIG. 11, the present invention is not limited in this regard as any number of such apertures may alternatively be defined without departing from the broader aspects of the present invention. Likewise, the matching apertures 82/84 may also have any size or shape in dependence upon specific performance characteristics or the like.

Figure 12:
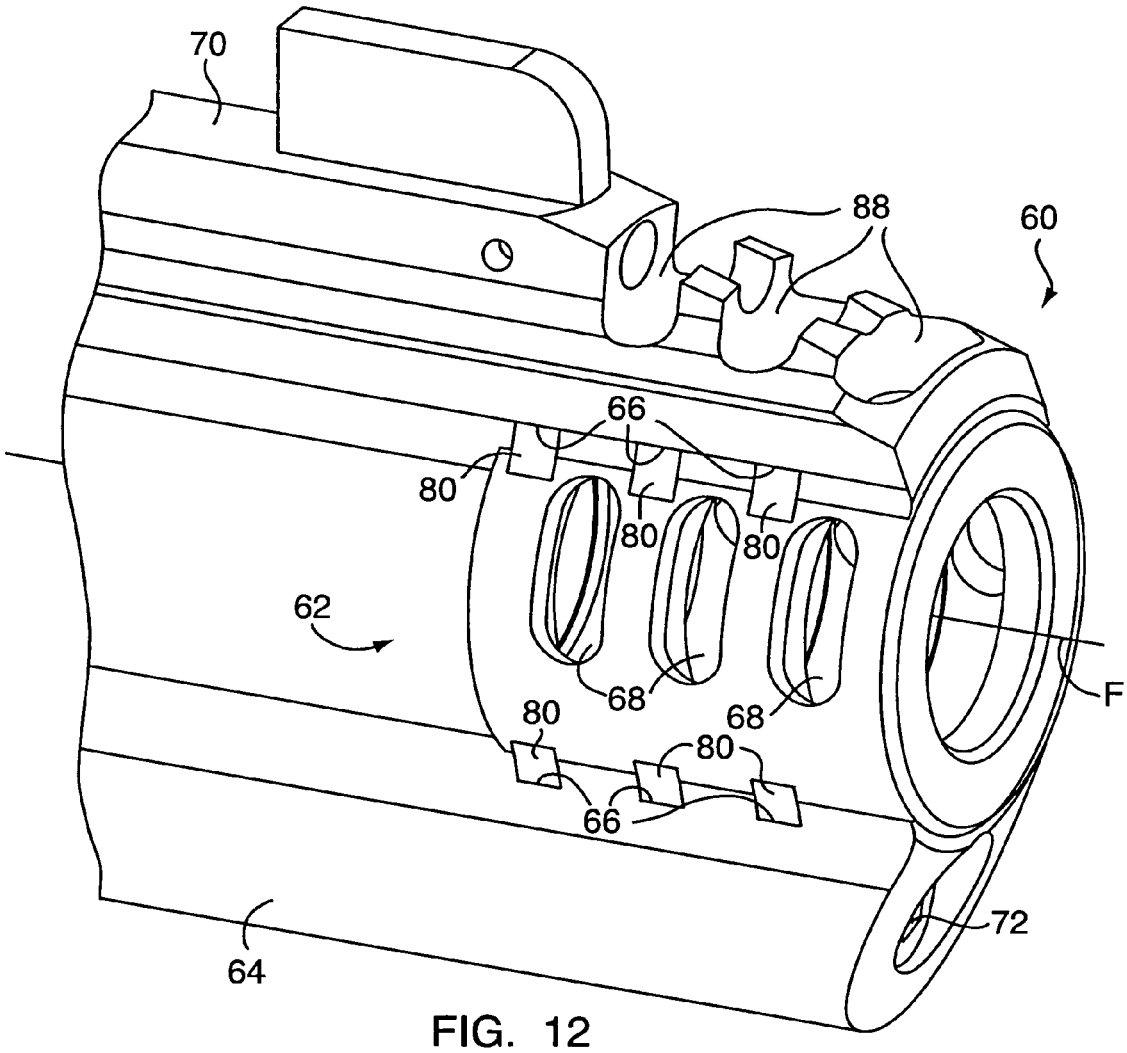
FIG. 12 is isomeric view of a compensation system for a firearm, in accordance with another embodiment of the present invention.

FIG. 12 illustrates another embodiment of the present invention in which the compensator assembly 62 includes a plurality of upper gas discharge apertures 88. As shown in FIG. 12, the upper gas discharge apertures, or ports, 88 define substantially arcuate profiles of differing arc lengths, similar to the discharge slots 14 as discussed in connection with FIGS. 1-8.

Figure 13:
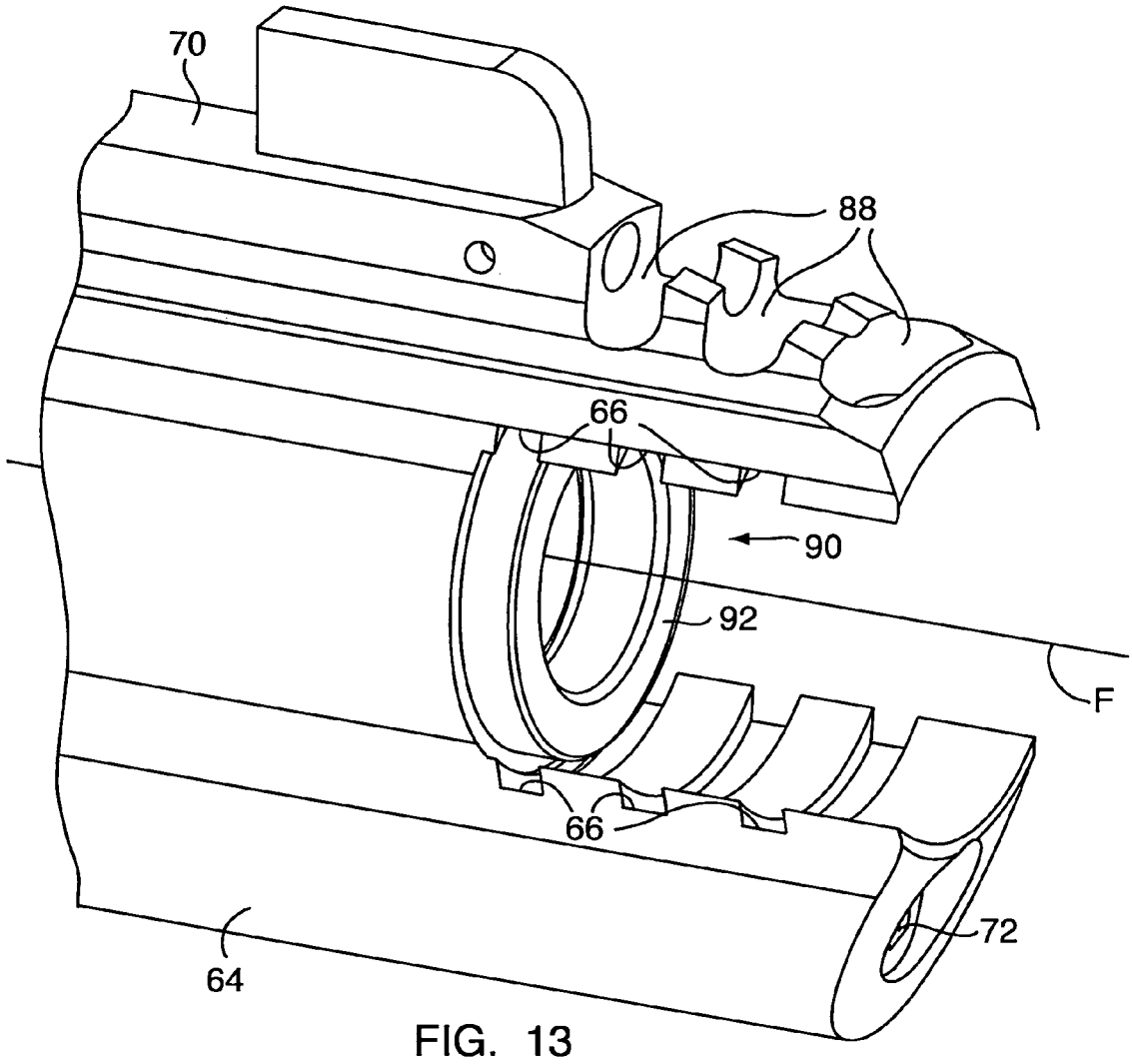
FIG. 13 is isomeric view of a compensation system for a firearm, in accordance with another embodiment of the present invention.

Although the embodiments of the compensation system 60 shown in FIGS. 9-12 may be useable with shrouds 64 which themselves define the barrel of the firearm, the present invention is not limited in this regard. As shown in FIG. 13, the shroud 64 may instead be designed so as to accept a barrel 90 having a front flange 92. That is, similar to the embodiment discussed in connection with FIGS. 1-8, and as understood by one skilled in the art, the shroud 64 may alternatively accept the barrel 90 such that the flange 92 has an external dimension which is several thousands of an inch larger than the external diameter of the barrel 90.

Preferably, the flange 92 is approximately 20 to 20 thousands of an inch greater in diameter than the barrel 90, and approximately 30 to 40 thousands of an inch in longitudinal depth. The barrel 90 may then be accommodated within the shroud 64 with its longitudinal travel being arrested by the engagement of the flange 92 against the body of the shroud 64, as depicted in FIG. 13. All other substantive aspects of the embodiments shown in FIGS. 9-12 are otherwise consistent with the embodiment of FIG. 13.

Indeed, the compensation systems of the present invention are equally applicable to every conceivable firearm, including handguns of all types, rifles, shotguns, semi-automatic and automatic firearms, in any caliber. In particular, the various cuts and grooves utilized in accommodating the compensator assemblies discussed herein may be alternatively formed in the shroud of a firearm, or in the barrel of a firearm, in dependence upon the specific structural design of the firearm, and without departing from the broader aspects of the present invention.

Figure 14:
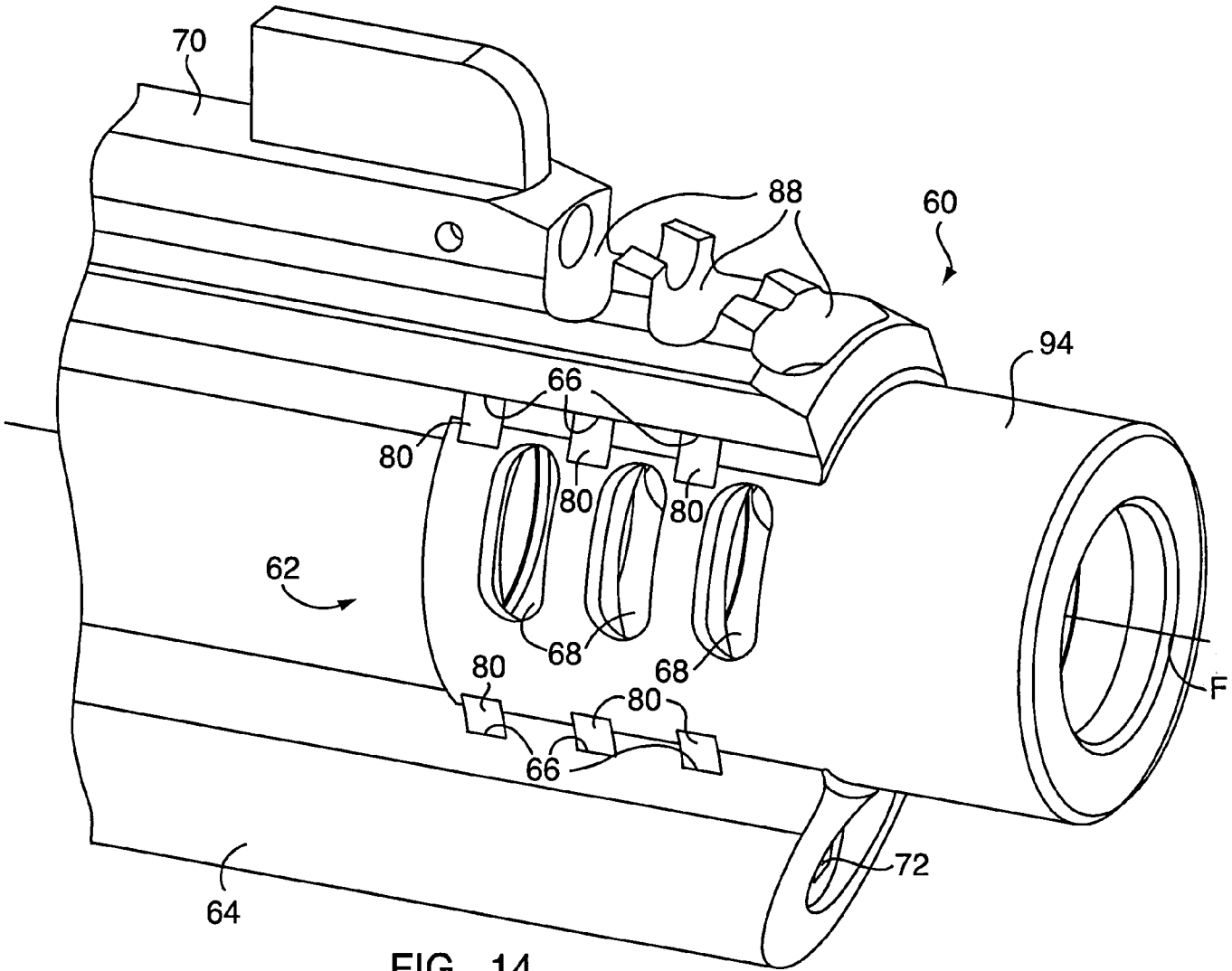
FIG. 14 is isomeric view of a compensation system for a firearm, in accordance with another embodiment of the present invention.
Figure 15:
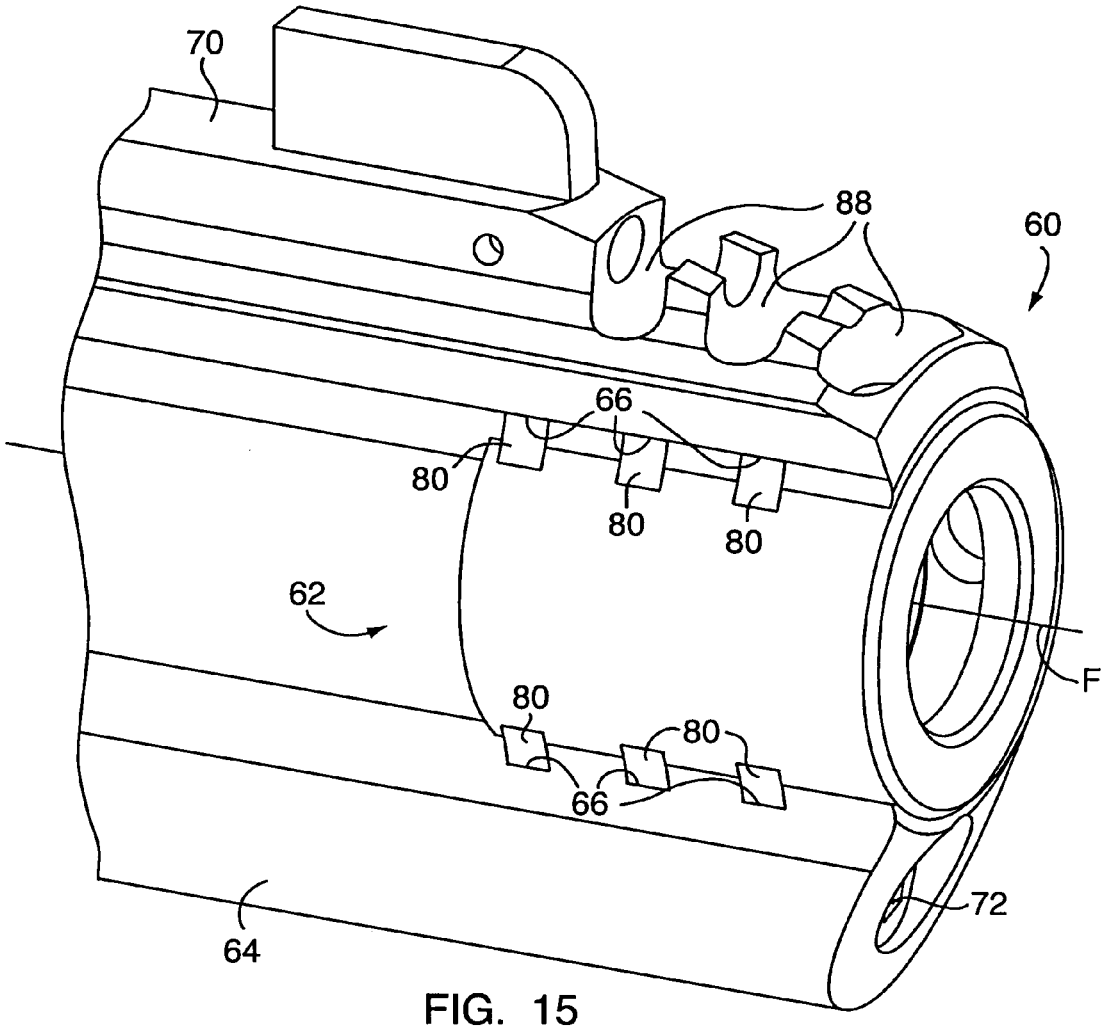
FIG. 15 is isomeric view of a compensation system for a firearm, in accordance with another embodiment of the present invention.

FIG. 14 illustrates another embodiment of the compensation system 60 in which the compensator assembly 62 includes a forwardly extending non-milled portion 94, in accordance with specific design and performance characteristics. Likewise, FIG. 14 illustrates another embodiment of the compensation system 60 in which the compensator assembly 62 may have no gas discharge ports at all. That is, the compensator assembly 62 shown in FIG. 15 may have only gas discharge ports formed in the upper side thereof, to communicate with the gas discharge apertures 88, or it may alternative have no gas discharge ports at all.

Another important aspect of the present invention therefore resides in the ability of the compensation system 60 to not only provide for the quick interchange between compensator assemblies having gas discharge ports of differing numbers, shapes, sizes and angular orientations, but also to accept compensator assemblies which have no gas discharge ports at all. Thus an operator may selectively determine when gas discharge ports are desired, and when they are not, and quickly alternative between these structural configurations by the simple actuation of the locking bolt 74.

Moreover, firearm owners may avail themselves of advancements made in compensator designs without the need to purchase a new firearm. Still yet another benefit of the present invention is that the manufacture and production of firearms may be largely standardized such that a generic firearm/shroud/barrel prototype may accommodate several differing configurations of compensator assemblies, thus significantly reducing material and production costs.

Still yet another important benefit of the present invention is that by having easily replaceable compensator assemblies, the present invention eliminates the need to purchase a new firearm, or repair one already owned, when the compensator assembly becomes worn over time, in stark contrast to known devices. Further, the cleaning and maintenance of the compensator assembly of the present invention is streamlined, thus significantly reducing maintenance time and effort.

As will be appreciated by consideration of FIGS. 1-15, the present invention provides a compensation system which includes a plurality of compensator assembly configurations, and which may be removably attached to the muzzle end of a firearm. Moreover, the various embodiments of the compensator assemblies may be employed without the need for destroying the integrity of the barrel of a firearm, or the lands and grooves of the rifling inscribed in the inner surface of the barrel. The present invention thus provides a compensation system having heretofore unknown benefits in discharge force allocation, as well as providing an interchange system which is quick and efficient, while not comprising the proper orientation or securing of the compensator assembly to the firearm itself.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all equivalent embodiments.

What is claimed is:

1. A compensation system for a firearm, said compensation system comprising:

a shroud having a longitudinal bore;

a barrel releasably housed within said shroud and defining thereby a firing axis, said barrel including an annular flange disposed on a distal end of said barrel for arresting a longitudinal translation of said barrel within said longitudinal bore, said annular flange having a flange diameter which is greater than an outer diameter of said barrel;

a compensator assembly including an attaching means for releasably attaching said compensator assembly adjacent a muzzle end of said barrel;

a gas discharge port formed in said compensator assembly, said gas discharge port not being aligned with said longitudinal bore and communicating with an inner bore of said compensator assembly; and wherein said shroud includes a recess formed therein and said attachment means is configured to be releasably accepted within said recess.

2. The compensation system for a firearm according to claim 1, further comprising:

a tensioning means for selectively preloading said attachment means within said recess in a direction substantially parallel to said firing axis.

3. A compensation system for a firearm, said compensation system comprising:

a shroud having a longitudinal bore;

a barrel releasably housed within said shroud and defining thereby a firing axis, said barrel including a flange disposed on a distal end of said barrel for arresting a longitudinal translation of said barrel within said longitudinal bore;

a compensator assembly including an attaching means for releasably attaching said compensator assembly adjacent a muzzle end of said barrel;

a gas discharge port formed in said compensator assembly, said gas discharge port not being aligned with said longitudinal bore and communicating with an inner bore of said compensator assembly;

a tensioning means for selectively preloading said attachment means within said recess in a direction substantially parallel to said firing axis;

said shroud includes a threaded bore formed beneath said longitudinal bore; and said tensioning means is a bolt that threadedly engages with said threaded bore.

4. The compensation system for a firearm according to claim 3, wherein:

said bolt includes a raised flange that selectively tensions said attachment means against said recess.

5. The compensation system for a firearm according to claim 4, wherein:

said shroud includes a gas aperture which is aligned with said gas discharge port when said compensator assembly is attached adjacent said muzzle end of said barrel.

6. A compensation system for a firearm, said compensation system comprising:

a shroud having a longitudinal bore;

a barrel releasably housed within said shroud and defining thereby a firing axis, said barrel including an annular flange disposed on a distal end of said barrel for arresting a longitudinal translation of said barrel within said longitudinal bore, said annular flange having a flange diameter which is greater than an outer diameter of said barrel;

a compensator assembly including an attaching means for releasably attaching said compensator assembly adjacent a muzzle end of said barrel;

a gas discharge port formed in said compensator assembly, said gas discharge port not being aligned with said longitudinal bore and communicating with an inner bore of said compensator assembly; and Wherein said shroud includes a gas aperture which is aligned and in fluid communication with said gas discharge port when said compensator assembly is attached adjacent said muzzle end of said barrel.

* * * * *

UNITED STATES PATENT AND TRADEMARK OFFICE

CERTIFICATE OF CORRECTION

PATENT NO. : 7,328,645 B1
APPLICATION NO. : 10/773500
DATED : February 12, 2008
INVENTOR(S) : Brett Curry et al.

It is certified that error appears in the above-identified patent and that said Letters Patent is hereby corrected as shown below:

Title page, section (60), line 3, after "2003", please insert -- , and U.S. Patent No. 6,266,908, issued July 31, 2001 --.

Signed and Sealed this

Second Day of September, 2008

JON W. DUDAS
*Director of the United States Patent and Trademark Office*